US009623657B2

(12) United States Patent
Choy et al.

(10) Patent No.: US 9,623,657 B2
(45) Date of Patent: Apr. 18, 2017

(54) FLUID DISPENSER

(71) Applicant: Hewlett-Packard Development Company, L.P., Houston, TX (US)

(72) Inventors: Silam J. Choy, Corvallis, OR (US); Garrett E. Clark, Corvallis, OR (US); Rio Rivas, Bend, OR (US); Ed Friesen, Corvallis, OR (US); Kelly Ronk, San Diego, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/850,129

(22) Filed: Sep. 10, 2015

(65) Prior Publication Data

US 2016/0001555 A1 Jan. 7, 2016

Related U.S. Application Data

(62) Division of application No. 14/359,241, filed as application No. PCT/US2011/066471 on Dec. 21, 2011, now Pat. No. 9,211,713.

(51) Int. Cl.
*B41J 2/14* (2006.01)
*B05B 1/14* (2006.01)

(52) U.S. Cl.
CPC ..... *B41J 2/1433* (2013.01); *B05B 1/14* (2013.01); *B41J 2/14145* (2013.01);
(Continued)

(58) Field of Classification Search
CPC ..... B41J 2/1433; B41J 2/14145; B41J 2002/14419; B41J 2202/07; B41J 2202/11;
(Continued)

(56) References Cited

U.S. PATENT DOCUMENTS 5,811,019 A 9/1998 Nakayama et al.
5,841,452 A * 11/1998 Silverbrook ..... B41J 2/1404 216/27
(Continued)

FOREIGN PATENT DOCUMENTS

JP 04148934 A * 5/1992
WO 2013095430 A1 6/2013

OTHER PUBLICATIONS

United States Patent and Trademark Office, "Non Final Office Action", issued in connection with U.S. Appl. No. 14/359,241 dated Apr. 10, 2015, (13 pages).
(Continued)

*Primary Examiner* — Matthew Luu
*Assistant Examiner* — Patrick King
(74) *Attorney, Agent, or Firm* — HP Inc.-Patent Department

(57) ABSTRACT

A fluid dispenser is disclosed herein. An example of such a fluid dispenser includes a member configured to define a plurality of orifices through which a fluid is ejected and a manifold including a plurality of fluid passageways each of which is configured to have a different angle relative to the member. This example of a fluid dispenser additionally includes a plurality of slots each of which is coupled to a different one of the fluid passageways of the manifold to conduct the fluid from the fluid passageways towards the orifices. Additional features and modifications of this fluid dispenser are disclosed herein, as are other examples of fluid dispensers.

20 Claims, 14 Drawing Sheets

(52) U.S. Cl.
CPC ..... *B41J 2002/14387* (2013.01); *B41J 2002/14419* (2013.01); *B41J 2202/07* (2013.01); *B41J 2202/11* (2013.01)

(58) Field of Classification Search
CPC ..... B41J 2002/14387; B41J 2/14032; B41J 2002/14169; B41J 2202/14306; B05B 1/14
See application file for complete search history.

(56) References Cited

U.S. PATENT DOCUMENTS

| | | | | |
|---|---|---|---|---|
| 5,969,739 | A | 10/1999 | Altendorf et al. | |
| 6,283,584 | B1 | 9/2001 | Powers et al. | |
| 6,416,156 | B1 | 7/2002 | Noolandi et al. | |
| 6,682,186 | B2 | 1/2004 | Smith et al. | |
| 7,303,260 | B2 | 12/2007 | Osada et al. | |
| 7,553,375 | B2 | 6/2009 | Sekiya | |
| 7,560,039 | B2 | 7/2009 | Krawczyk et al. | |
| 7,833,426 | B2 | 11/2010 | Clarke et al. | |
| 7,966,728 | B2 | 6/2011 | Buswell | |
| 8,733,902 | B2 * | 5/2014 | Chung | B41J 2/1404 347/65 |
| 2003/0030709 | A1 | 2/2003 | Deshmukh et al. | |
| 2004/0233254 | A1 * | 11/2004 | Kim | B41J 2/1404 347/56 |
| 2005/0280680 | A1 | 12/2005 | Hess et al. | |
| 2007/0210031 | A1 | 9/2007 | Clarke et al. | |
| 2008/0259125 | A1 | 10/2008 | Haluzak et al. | |
| 2009/0096835 | A1 | 4/2009 | Nagata | |
| 2009/0189958 | A1 | 7/2009 | Ogata | |
| 2009/0284572 | A1 * | 11/2009 | Katoh | B41J 2/14145 347/85 |
| 2009/0295870 | A1 | 12/2009 | Goin et al. | |
| 2010/0165048 | A1 * | 7/2010 | DeBrabander et al. | B41J 2/161 347/47 |
| 2011/0115853 | A1 | 5/2011 | Long | |
| 2013/0244352 | A1 * | 9/2013 | Takahashi | H01L 21/30604 438/21 |
| 2014/0327720 | A1 | 11/2014 | Choy et al. | |

OTHER PUBLICATIONS

United States Patent and Trademark Office, "Notice of Allowance", issued in connection with U.S. Appl. No. 14/359,241 dated Aug. 28, 2015, (16 pages).
Patent Cooperation Treaty, "Written Opinion", issued in connection with PCT Application No. PCT/US2011/066471, mailed on Sep. 25, 2012, (4 pages).
Patent Cooperation Treaty, "International Search Report", issued in connection with PCT Application No. PCT/US2011/066471, mailed on Sep. 25, 2012, (7 pages).
United Stated Patent and Trademark Office, "Restriction Requirement", issued in connection with U.S. Appl. No. 14/359,241 dated Dec. 26, 2014, (8 pages).

* cited by examiner

FLUID DISPENSER

RELATED APPLICATION

This patent arises from a division of U.S. patent application Ser. No. 14/359,241, which was filed on filed May 19, 2014, which claims priority to International Patent Application No. PCT/US2011/066471, which was filed on Dec. 21, 2011. U.S. patent application Ser. No. 14/359,241 and International Patent Application No. PCT/US2011/066471 are hereby incorporated herein by reference in their entireties.

BACKGROUND

A challenge exists to deliver quality and value to consumers, for example, by providing reliable printing devices that are cost effective. Further, businesses may desire to enhance the performance of their printing devices, for example, by increasing the speed and accuracy of the functioning of one or more components of such printing devices.

BRIEF DESCRIPTION OF THE DRAWINGS

The following detailed description references the drawings, wherein.

DETAILED DESCRIPTION

Reliability of fluid dispensers, such as inkjet printheads used in printing devices, is desirable. Quality of fluid dispenser output (e.g., print resolution) is also desirable. Throughput, such as printed output pages per minute, is also a design consideration.

Figure 1:
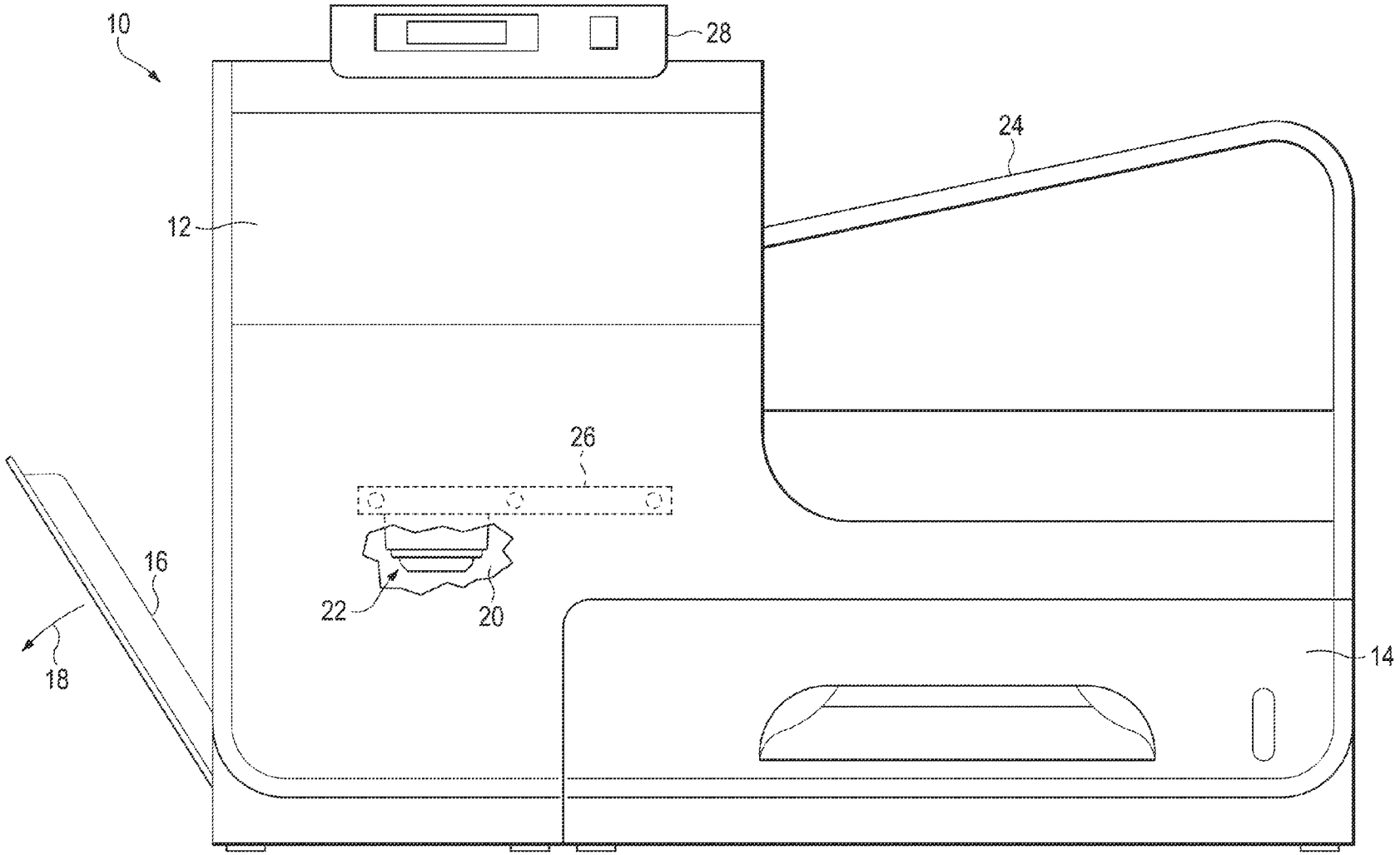
FIG. 1 is a view of an example of a printing device.

An example of a printing device 10 is shown in FIG. 1. Printing device 10 includes a housing 12 in which components of the printing device 10 are enclosed, a print media input tray 14 that stores a supply of print media (not shown), and an access door 16 that may be opened in the direction of arrow 18 to provide access to interior 20. Printing device 10 additionally includes a printing assembly 22 located in interior 20 that places text and images on print media as it is transported from input tray 14 to print media output tray 24 where it may be collected by end users. As can be seen in FIG. 1, printing assembly 22 is mounted in interior 20 of printing device 10 by a support assembly 26. Printing device 10 additionally includes a user interface 28 for controlling printing device 10 and providing status information to end users. It is to be understood that some components of printing device 10 are not shown in FIG. 1, such as a print media transport mechanism, control electronics, servicing components for printing assembly 22, a duplex mechanism, etc.

Figure 2:
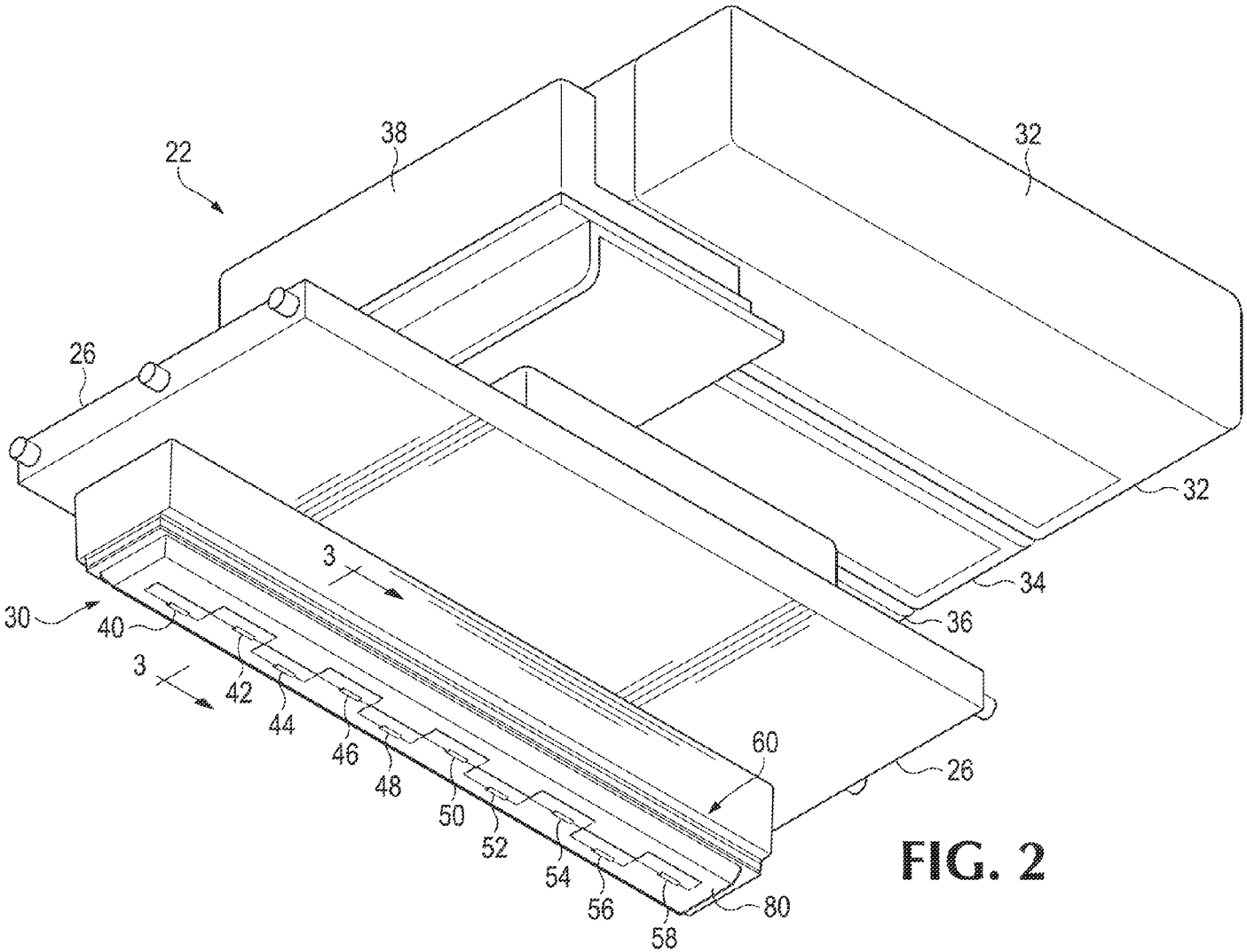
FIG. 2 is view of an example of a printing assembly.

An example of a printing assembly 22 is shown in FIG. 2. As can be seen in FIG. 2, printing assembly 22 includes a fluid dispenser 30 and a plurality of fluid containers 32, 34, and 36. Fluid containers 32, 34, and 36 are each configured to store a fluid that is supplied to fluid dispenser 30 via connection assembly 38 shown in FIG. 2. In this example, the fluid is ink of different colors, but may be different in other examples and applications (e.g., fixer, paint, biological material, etc.). Although only three containers are shown in FIG. 2, it is to be understood that four are actually utilized in the illustrated example. It is also to be understood that other examples may utilize a greater or lesser number of fluid containers.

Fluid dispenser 30 includes a plurality of members 40, 42, 44, 46, 48, 50, 52, 54, 56, and 58 each of which includes a plurality of orifices (not shown in FIG. 2) through which the fluid stored in containers 32, 34, and 36 is ultimately ejected. In the example shown, each member 40, 42, 44, 46, 48, 50, 52, 54, 56, and 58 is a printhead, as discussed more fully below. Fluid dispenser 30 additionally includes a fluid delivery assembly 60 that is coupled to fluid containers 32, 34, and 36 and members 40, 42, 44, 46, 48, 50, 52, 54, 56, and 58 to conduct the fluid from containers 32, 34, and 36 to the orifices of members 40, 42, 44, 46, 48, 50, 52, 54, 56, and 58. Fluid delivery assembly 60 is configured to include a bubble purging assembly that conducts any bubbles that result from ejection of the fluid from the orifices, as well as any bubbles arising from increasing a temperature of the fluid, to fluid containers 32, 34, and 36 to help prevent clogging of fluid delivery assembly 60. This, in turn, helps maintain the reliability of printing device 10, as well as its output print quality and throughput.

Figure 3:
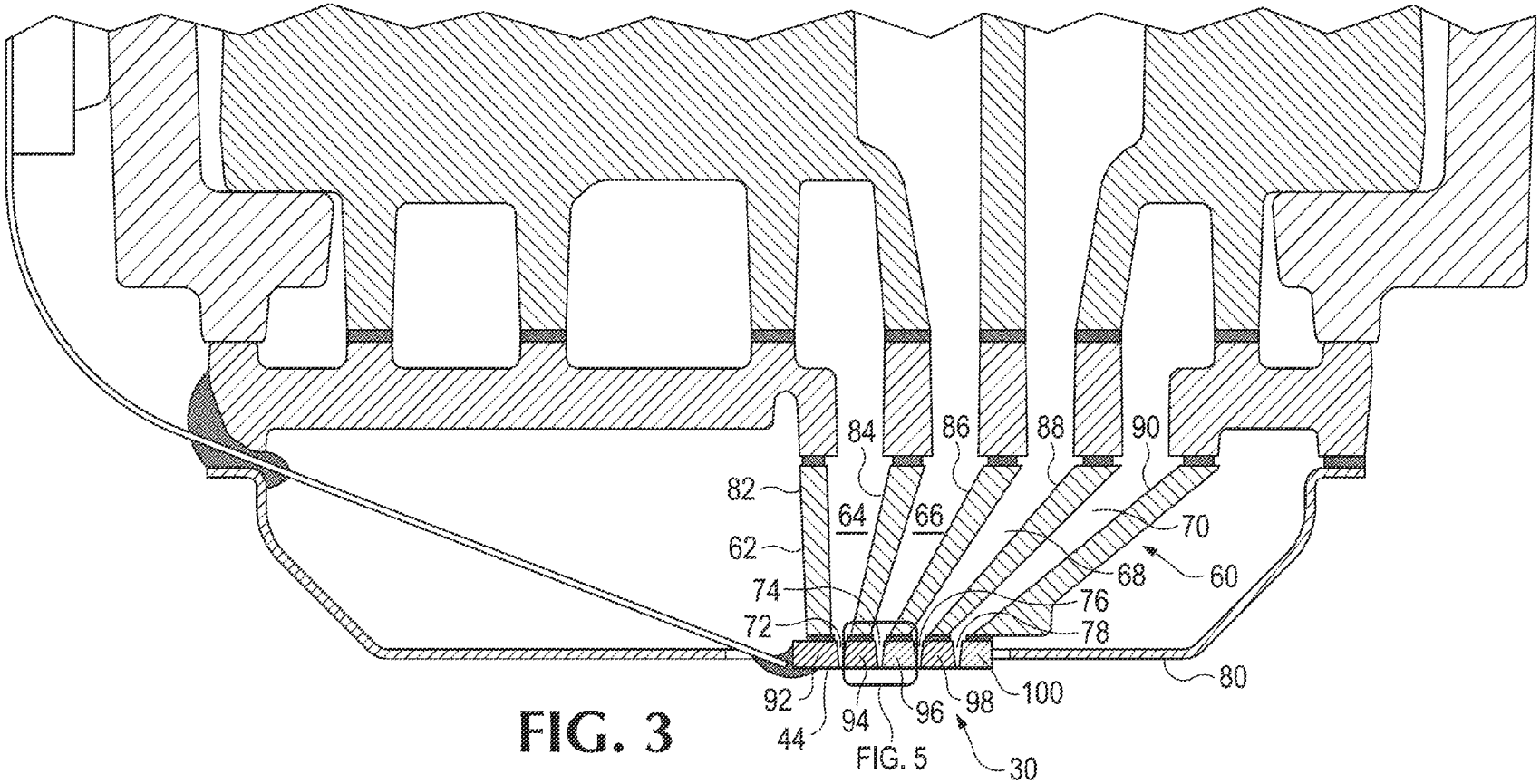
FIG. 3 is a cross-sectional view taken along line 3-3 of FIG. 2.

A cross-sectional view taken along line 3-3 of FIG. 2 is shown in FIG. 3. As can be seen in FIG. 3, fluid delivery assembly 60 includes a manifold 62 that includes plurality of differently slanted fluid passageways 64, 66, 68, and 70 each of which is configured to have a different angle relative to member 44 as shown. Fluid delivery assembly 60 additionally includes a plurality of slots 72, 74, 76, and 78 each of which is coupled to a different respective fluid passageway 64, 66, 68, and 70 of manifold 62 to conduct fluid from fluid passageways 64, 66, 68, and 70 towards the orifices (not shown in FIG. 3) of member 44. In the example shown in FIG. 3, the orientation of the fluid assembly 60 is manifold 62 above member 44, which in turn is above the orifices (not shown). This orientation enables buoyant conveyance of bubbles from the orifices through the member 44 and through the manifold 62. In the example shown in FIG. 3, fluid passageway 64 conducts yellow ink, fluid passageway 66 conducts magenta ink, fluid passageway 68 conducts cyan ink, and fluid passageway 70 conducts black ink.

Slanted fluid passageways 64, 66, 68, and 70 are angled to enable close placement of adjacent staggered members 40, 42, 44, 46, 48, 50, 52, 54, 56, and 58 on print bar 80 (see FIG. 2) of fluid dispenser 30. This grouping of printheads 40, 42, 44, 46, 48, 50, 52, 54, 56, and 58 allows printing device 10 to print across the full width of print media simultaneously which increases the throughput of printing device 10. Manifold 62 of fluid delivery assembly 60 is configured to include additional slots and slanted fluid passageways (neither of which are shown) for each of members 40, 42, 46, 48, 50, 52, 54, 56, and 58 to conduct fluid from containers 32, 34, and 36. The angles and shapes of these additional fluid passageways and slots may be the same or different than those shown for fluid passageways 64, 66, 68, and 70 and slots 72, 74, 76, and 78.

Referring again to FIG. 3, each of fluid passageways 64, 66, 68, and 70 is defined by a different pair of walls or members 82, 84, 86, 88, and 90 of manifold 62, as shown. As can also be seen in FIG. 3, each of slots 72, 74, 76, and 78 is defined by a different pair of walls or members 92, 94, 96, 98, and 100 of printhead 44. As can further be seen in FIG. 3, each of fluid passageways 64, 66, 68, and 70 is configured to have a different cross-sectional width adjacent the respective slot 72, 74, 76, and 78 to which the fluid passageway is coupled.

Figure 4:
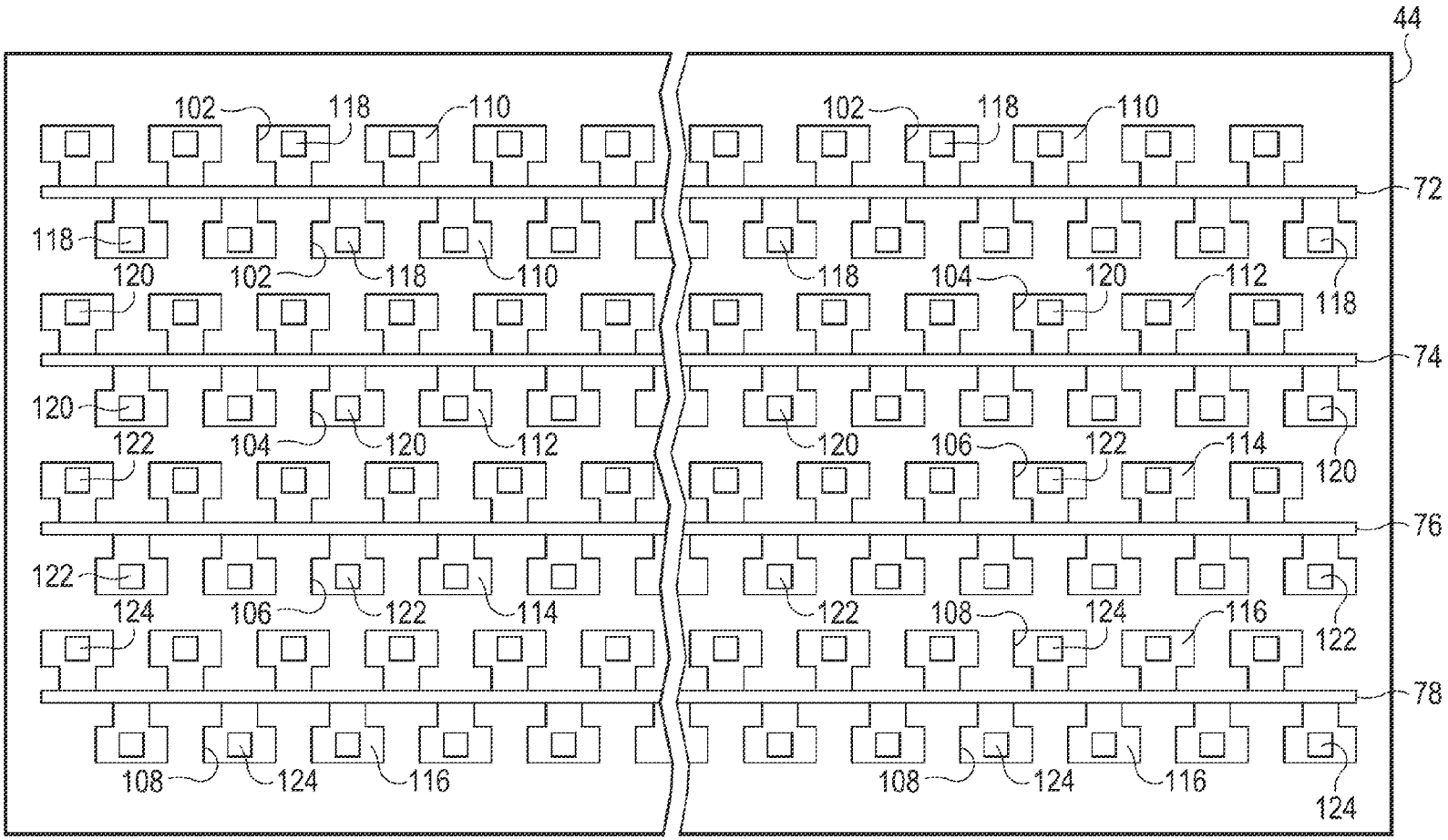
FIG. 4 is an example of an enlarged view of a member or printhead.

An enlarged view of member or printhead 44 is shown in FIG. 4. Slots 72, 74, 76, and 78 can be seen, as can respective orifices 102, 104, 106, and 108, referenced above. Printhead 44 additionally includes a plurality of fluid chambers 110, 112, 114, and 116, each of which are coupled to respective slots 72, 74, 76, and 78, and each of which are configured to receive a supply of fluid from a different one of slots 72, 74, 76, 78. In the example shown in FIG. 4, fluid chambers 110 receive yellow ink via slot 72, fluid chambers 112 receive magenta ink from slot 74, fluid chambers 114 receive cyan ink from slot 76, and fluid chambers 116 receive black ink from slot 78.

As can be seen in FIG. 4, printhead 44 additionally includes a plurality of actuators 118, 120, 122, and 124 positioned in respective fluid chambers 110, 112, 114, and 116. Actuators 118, 120, 122, and 124 are configured on actuation to eject a drop of fluid through one of the respective orifices 102, 104, 106, and 108. In the example shown in FIG. 4, actuators 118, 120, 122, and 124 are resistors that are energized to heat the fluid in respective chambers 110, 112, 114, and 116 to a boiling point that forms drops that are ejected through respective orifices 102, 104, 106, and 108.

Figure 5:
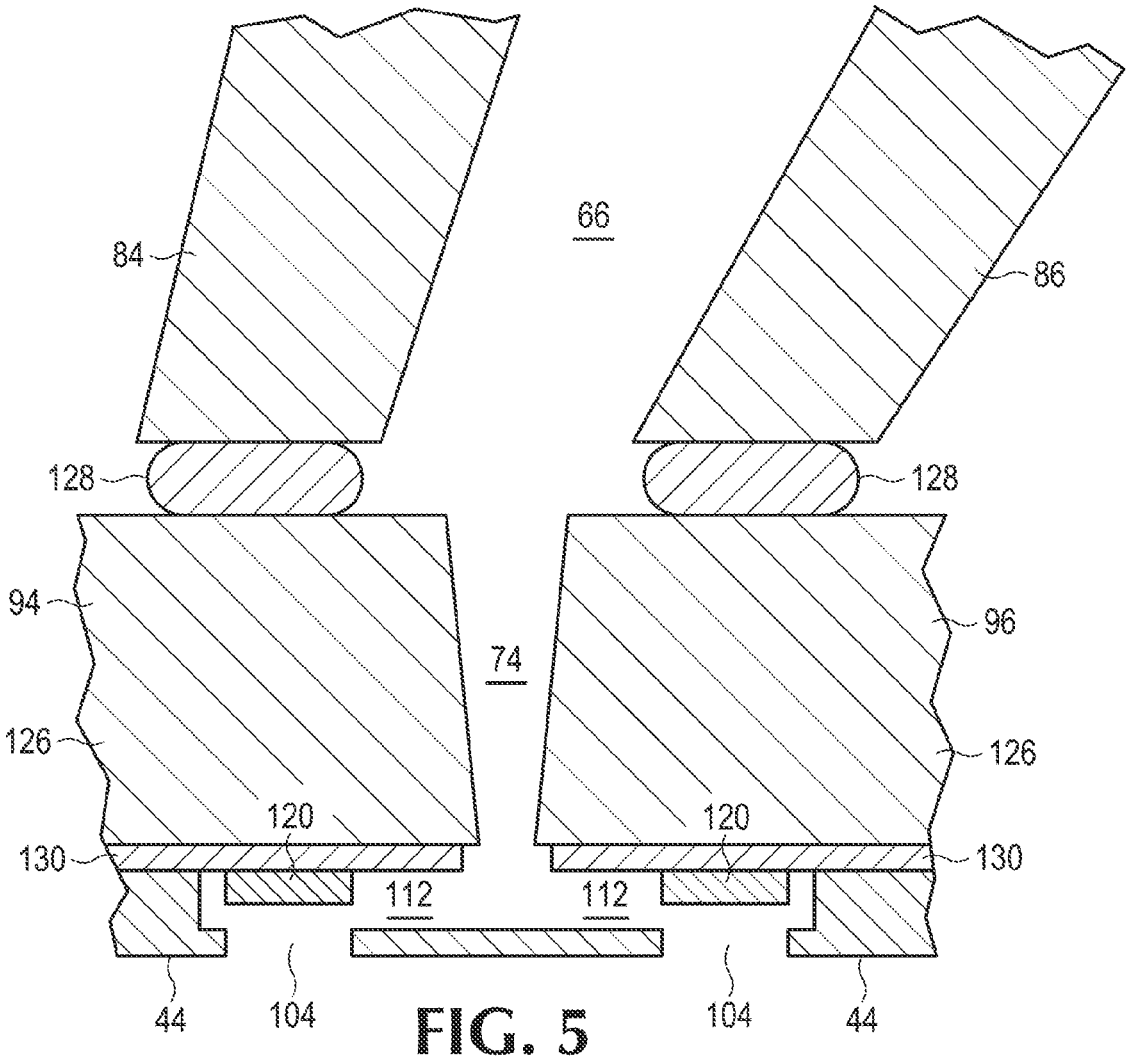
FIG. 5 is an enlarged view of the circled area of FIG. 3.

An enlarged view of the circled area of FIG. 3 is shown in FIG. 5. As can be seen in FIG. 5, members 84 and 86 of manifold 62 (which define fluid passageway 66) are attached to respective walls 94 and 96 of substrate 126 (which define slot 74) by an adhesive 128. In this example, manifold 62 is made from an inert material, such as a plastic or other polymer, metal, or ceramic, each of which tends not to interact with the fluid. Substrate 126 is formed from a suitable semiconductor material such as silicon. As can also be seen in FIG. 5, actuators 120 are positioned on a thinfilm layer 130 that is deposited on substrate 126. In this example, thinfilm layer 130 is made from a suitable material that insulates the conductors going to actuators 120 (not shown) that are positioned therein. Actuators 120 are made from any suitable resistive material, such as tungsten silicon nitride, which heats upon application of power thereto. Member 44 forms both the firing chamber and the orifice plate. Suitable materials for member 44 include a photoimageable epoxy such as SU8 or dielectric materials such as silicon oxide, silicon carbide, or silicon nitride.

Figure 6A:
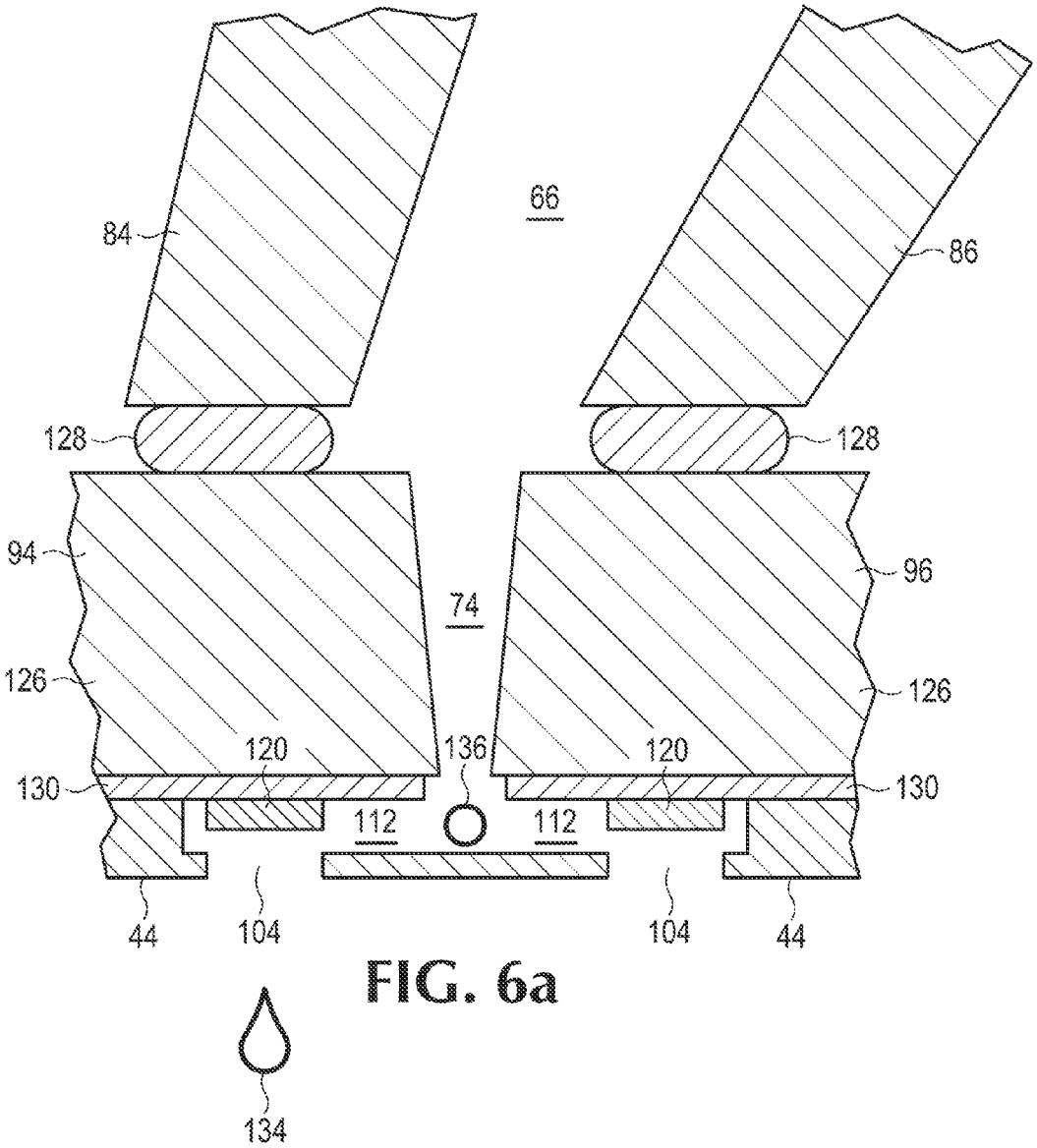
FIGS. 6*a*-6*e* illustrate an example of a bubble purging assembly.

An example of a bubble purging assembly of the present invention is illustrated in FIGS. 6*a*-6*e*. More specifically, FIG. 6*a* shows a drop 134 of fluid (not shown) that has been ejected through orifice 104 via energizing actuator 120 to heat the fluid to a sufficient level. This fluid is supplied by one of containers 32, 34, or 36 via fluid passageway 66 and slot 74 to chamber 112. Energizing actuator 120, which leads to ejected drop 134, additionally heats thinfilm layer 130 and silicon 126 which heats the fluid and leads to formation of bubble 136 because the heated fluid has a lower solubility for dissolved air. Additionally bubble 136 may form in fluid chamber 112 either from ejecting drop 134 or ingesting an air bubble during refill of chamber 112. Bubble 136 by itself or in combination with other bubbles (not shown) may clog or block fluid delivery assembly 60 which is undesirable. To help prevent this from occurring, bubbles, such as bubble 136, need to be buoyantly conveyed away from fluid chamber 112 through slot 74 and passageway 66 to a safe air storage location (not shown). The geometric shape of slot 74 and the relative cross-sectional widths of slot 74, adhesive 128, and fluid passageway 66 help achieve this desired result.

Figure 6B:
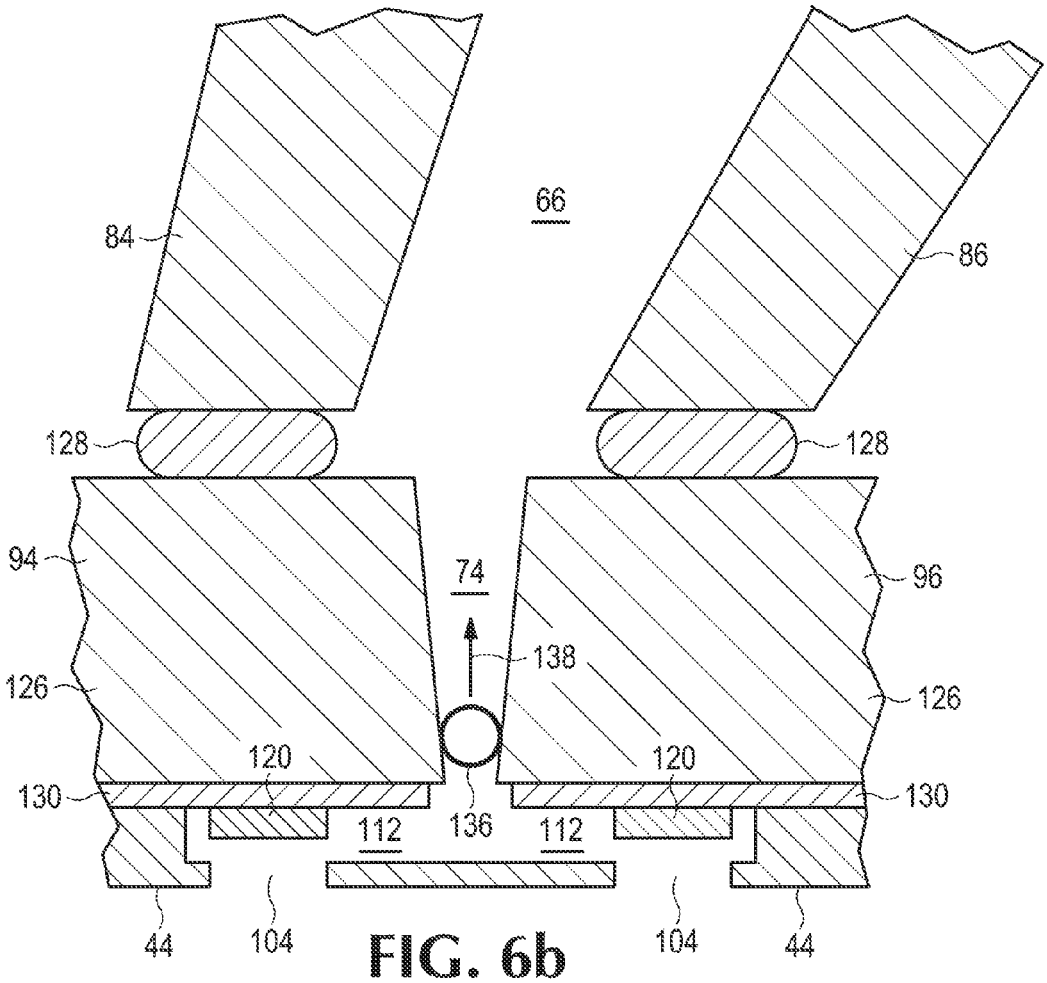
Figure 6C:
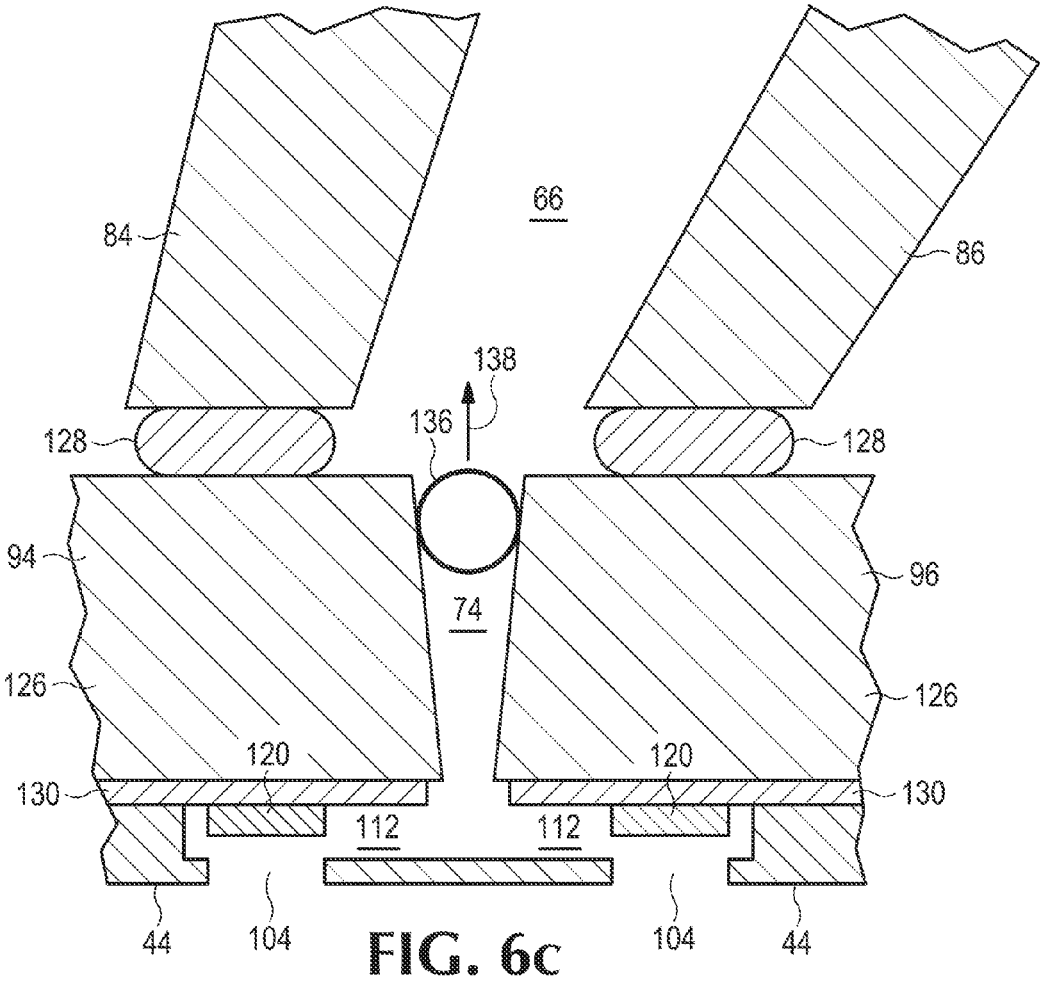

As can be seen in FIG. 6*b*, bubble 136 has traveled from its original position in chamber 112 shown in FIG. 6*a* to the position in slot 74 that is shown. As can also be seen in FIG. 6*b*, slot 74 is configured to increase in taper in a direction away from member 44 toward adhesive 128. That is, the cross-sectional width of slot 74 adjacent member 44 is less than the cross-sectional width adjacent adhesive 128. This helps encourage bubble 136 to travel through the fluid in the direction of arrow 138 to the position shown in FIG. 6*c*.

Figure 6D:
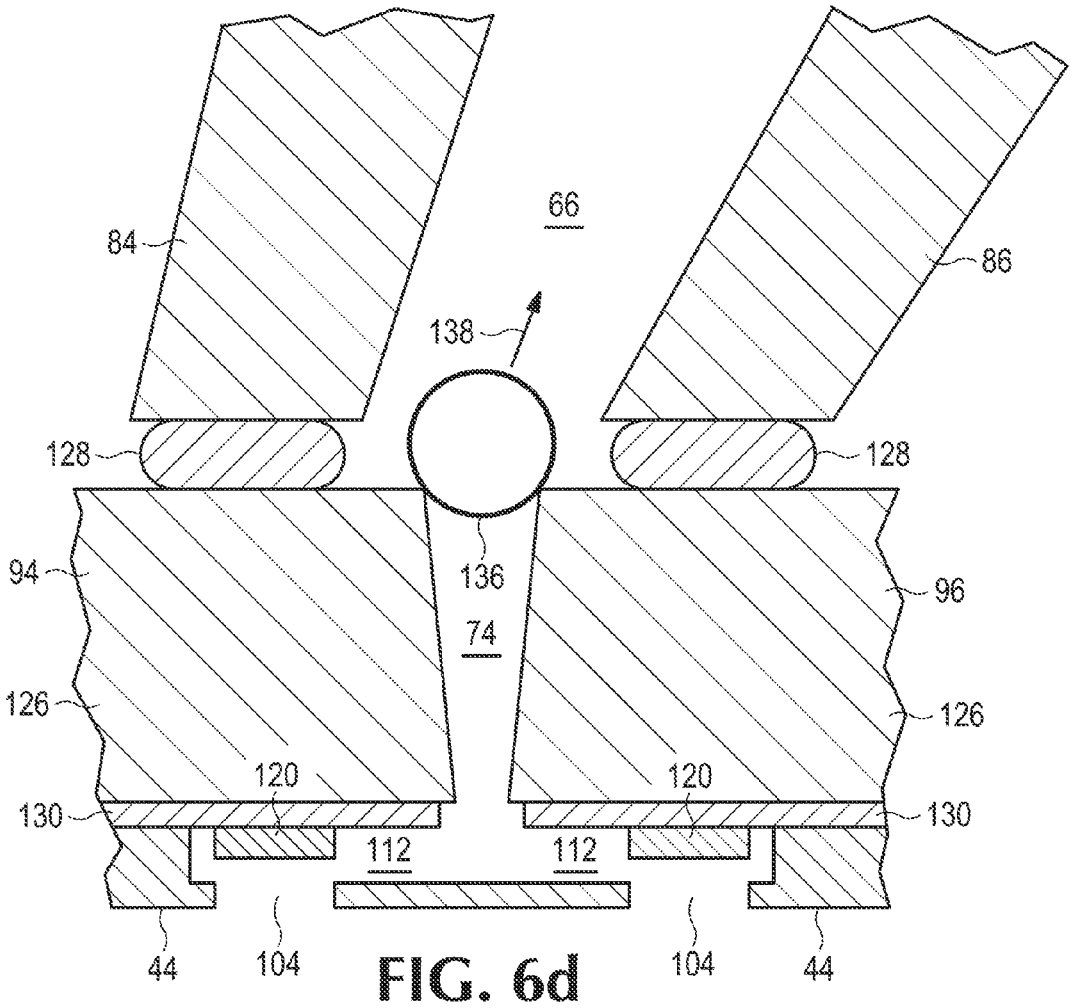
Figure 6E:
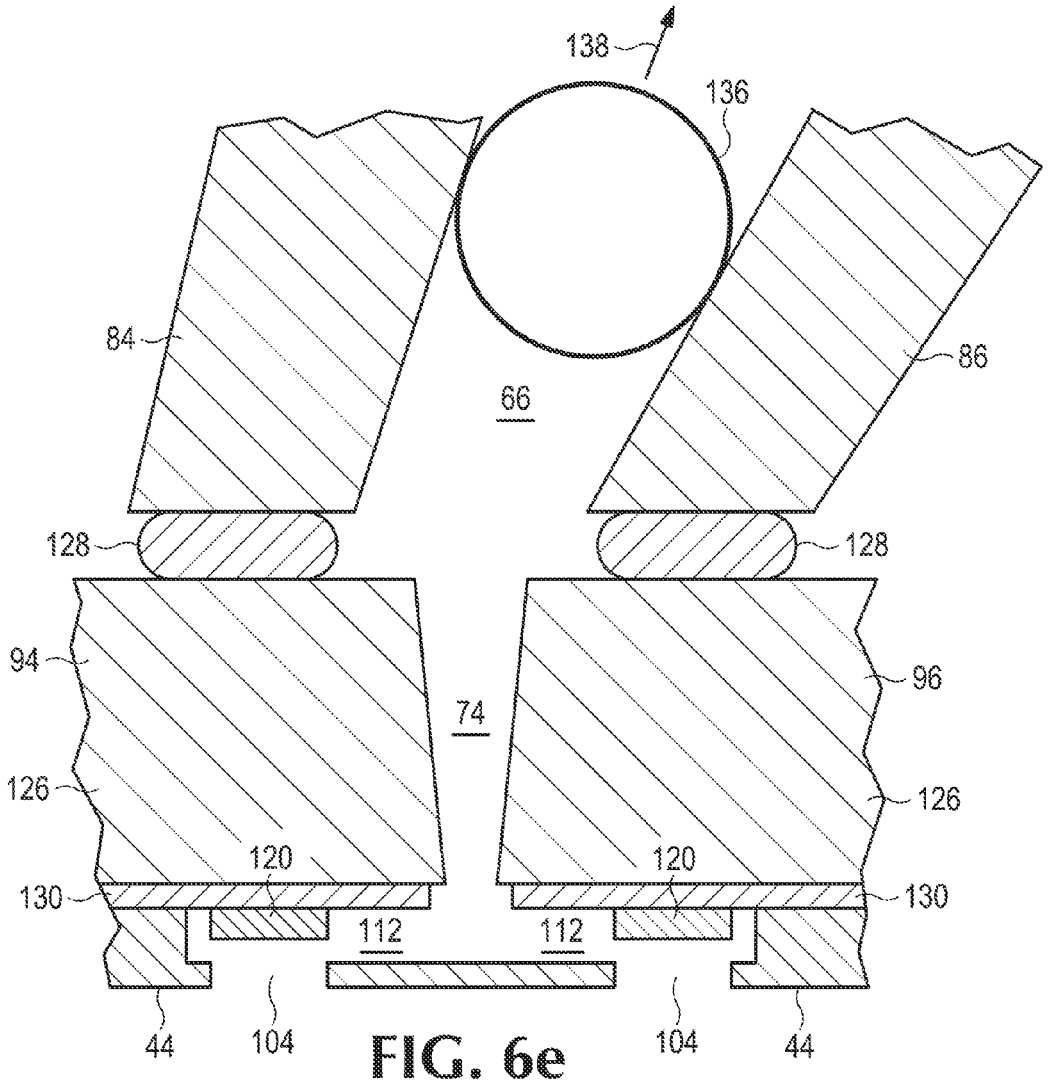

As can be seen in FIG. 6*d*, the cross sectional width of adhesive 128 is configured to be greater than the cross-sectional width of adjacent slot 74. This helps facilitate the conveyance of bubble 136 from slot 74 through the fluid toward fluid passageway 66, as generally indicated by arrow 138. As can also be seen, the cross-sectional width of fluid passageway 66 adjacent adhesive 128 is configured to be greater than adhesive 128. This helps facilitate the conveyance of bubble 136 from adhesive 128 into fluid passageway 66, as shown in FIG. 6*e*. In some examples, a height of adhesive 128 is configured to be approximately less than one-half (½) the cross-sectional width of the opening of adhesive 128. As can be seen in FIG. 6*e*, fluid passageway 66 is configured to increase in taper in a direction away from member 44 and adhesive 128 toward fluid containers 32, 34, and 36. That is, the cross-sectional width of fluid passageway 66 increases in a direction away from adhesive 128. This helps encourage bubble 136 to travel through the fluid in the direction of arrow 138 to the position shown in FIG. 6*e* and ultimately to a safe air storage location (not shown).

Figure 7:
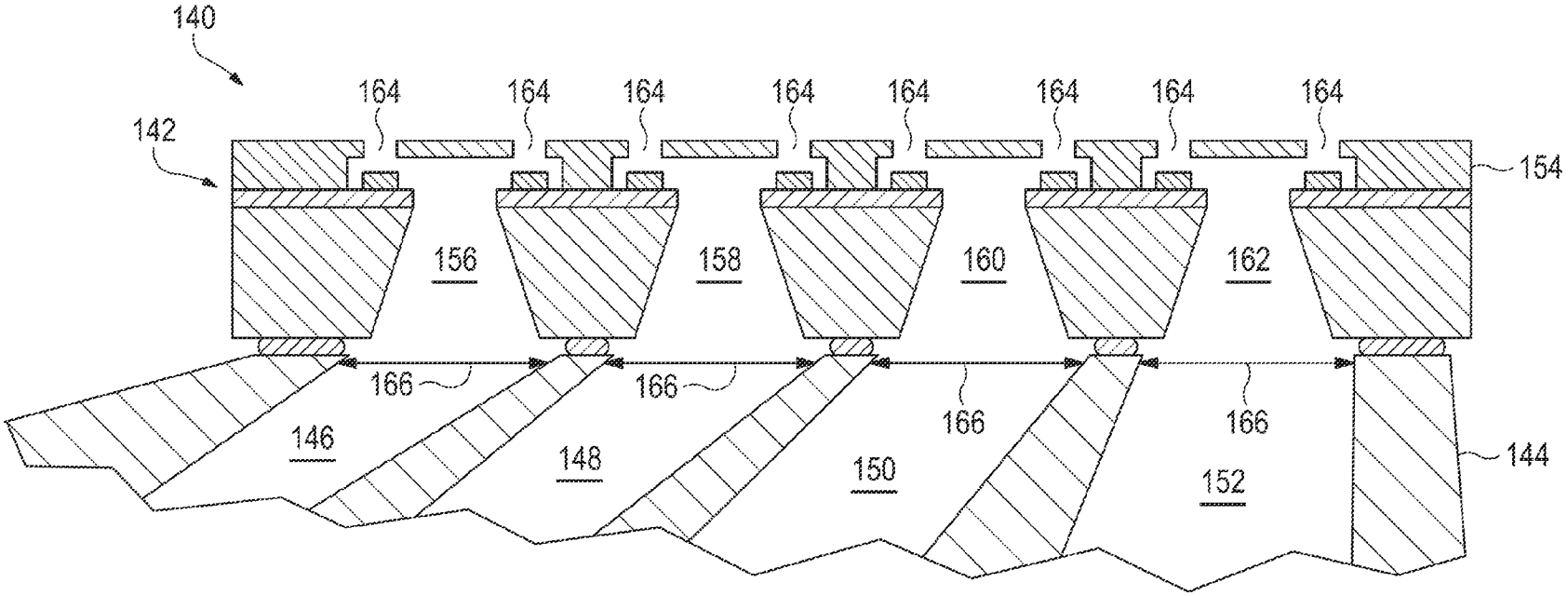
FIG. 7 is an enlarged view of an alternative example of a portion of a fluid dispenser.

An enlarged view of an alternative example of a portion of a fluid dispenser 140 is shown in FIG. 7. As can be seen in FIG. 7, fluid delivery assembly 142 of fluid dispenser 140 includes a manifold 144 that is configured to include a plurality of differently slanted fluid passageways 146, 148, 150, and 152 each of which is configured to have a different angle relative to member 154 as shown. Fluid delivery assembly 142 additionally includes a plurality of slots 156, 158, 160, and 162 each of which is coupled to a different respective fluid passageway 146, 148, 150, and 152 of manifold 144 to conduct fluid from fluid passageways 146, 148, 150, and 152 towards orifices 164 of member 154. In this example, slots 156, 158, 160, and 162 are configured to have a substantially similar shape. Additionally, each of fluid passageways 146, 148, 150, and 152 are configured to have a substantially similar cross-sectional width adjacent respective slots 156, 158, 160, and 162, as generally indicated by double arrows 166.

Figure 8:
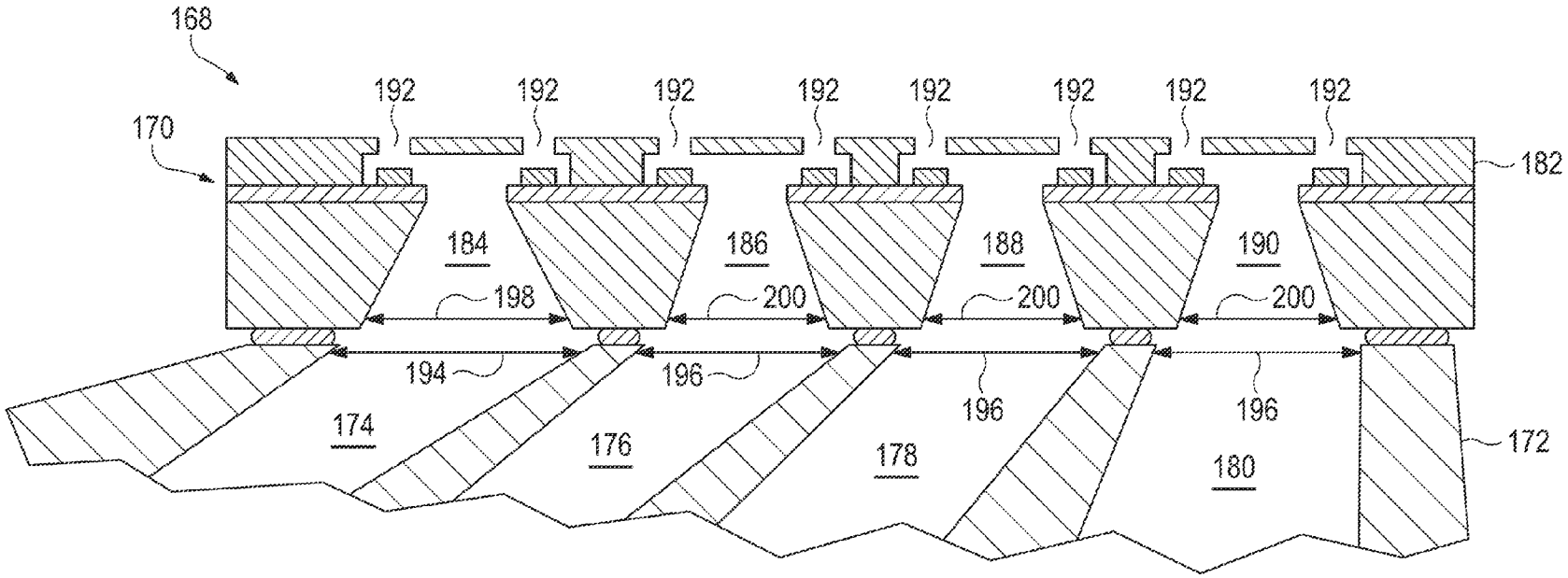
FIG. 8 is an enlarged view of another example of a portion of a fluid dispenser.

An enlarged view of another example of a portion of a fluid dispenser 168 is shown in FIG. 8. As can be seen in FIG. 8, fluid delivery assembly 170 of fluid dispenser 168 includes a manifold 172 that is configured to include a plurality of differently slanted fluid passageways 174, 176, 178, and 180 each of which is configured to have a different angle relative to member 182 as shown. Fluid delivery assembly 170 additionally includes a plurality of slots 184, 186, 188, and 190 each of which is coupled to a different respective fluid passageway 174, 176, 178, and 180 of manifold 172 to conduct fluid from fluid passageways 174, 176, 178, and 180 towards orifices 192 of member 182. In this example, fluid passageway 174 is configured to have a greater cross-sectional width adjacent slot 184 than fluid passageways 176, 178, and 180 adjacent respective slots 186, 188, and 190, as generally indicated by double arrows 194 and 196. The greater cross-section width 194 enables a bubble the size of the backside of slot 184 to convey through fluid passageway 174. Thus, a bubble of a size, as generally indicated by double arrow 200, is smaller in size than any minimum fluidic width of fluid passageway 174.

Figure 9:
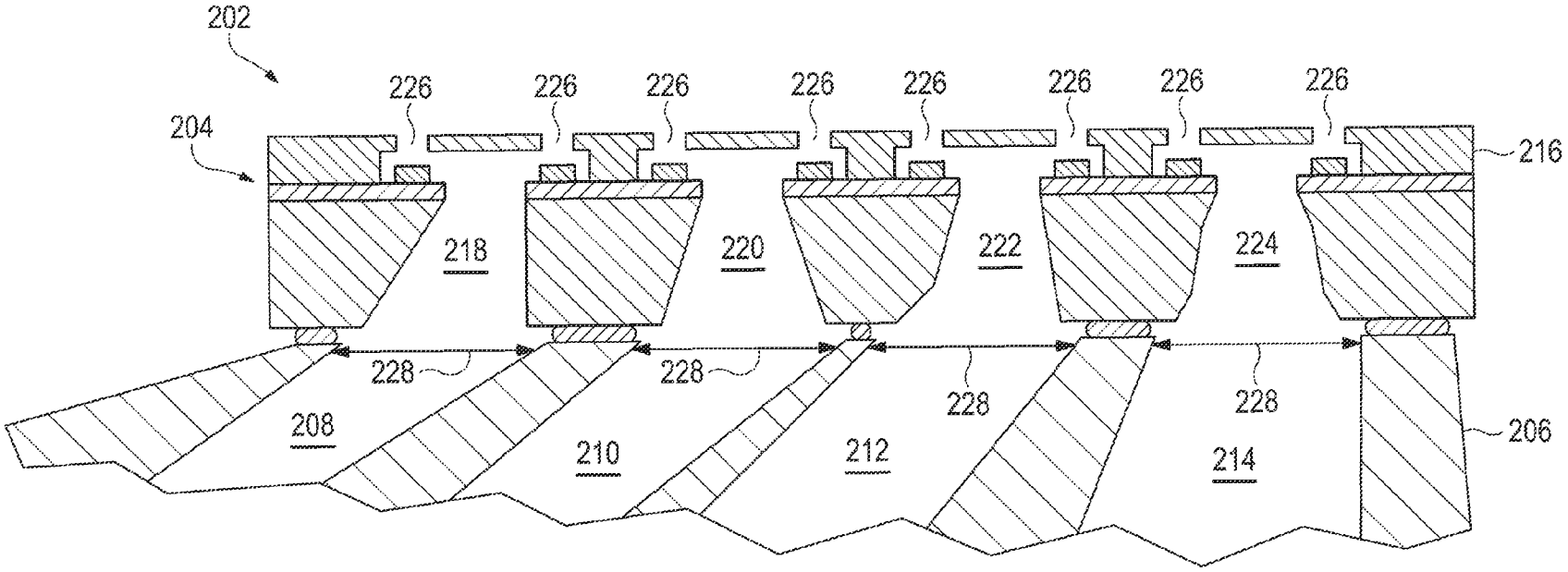
FIG. 9 is an enlarged view of a further example of a portion of a fluid dispenser.

An enlarged view of a further example of a portion of a fluid dispenser 202 is shown in FIG. 9. As can be seen in FIG. 9, fluid delivery assembly 204 of fluid dispenser 202 includes a manifold 206 that is configured to include a plurality of differently slanted fluid passageways 208, 210, 212, and 214 each of which is configured to have a different angle relative to member 216 as shown. Fluid delivery assembly 204 additionally includes a plurality of slots 218, 220, 222, and 224 each of which is coupled to a different respective fluid passageway 208, 210, 212, and 214 of manifold 206 to conduct fluid from fluid passageways 208, 210, 212, and 214 towards orifices 226 of member 216. In this example, each of slots 218, 220, 222, and 224 are configured to have a different geometric shape. Also in this example, as can be seen, slot 218 is asymmetrically configured. Additionally, each of fluid passageways 208, 210, 212, and 214 are configured to have a substantially similar cross-sectional width adjacent respective slots 218, 220, 222, and 224, as generally indicated by double arrows 228. Each of the slots 218, 220, 222 and 224 are configured such that the maximum backside dimension is smaller than the minimum fluidic width of fluid passageways 208, 210, 212 and 214 respectively. This is to limit bubble size at the exit of slots 218, 220, 222 and 224 to convey bubbles through passageways 208, 210, 212 and 214 respectively.

Figure 10:
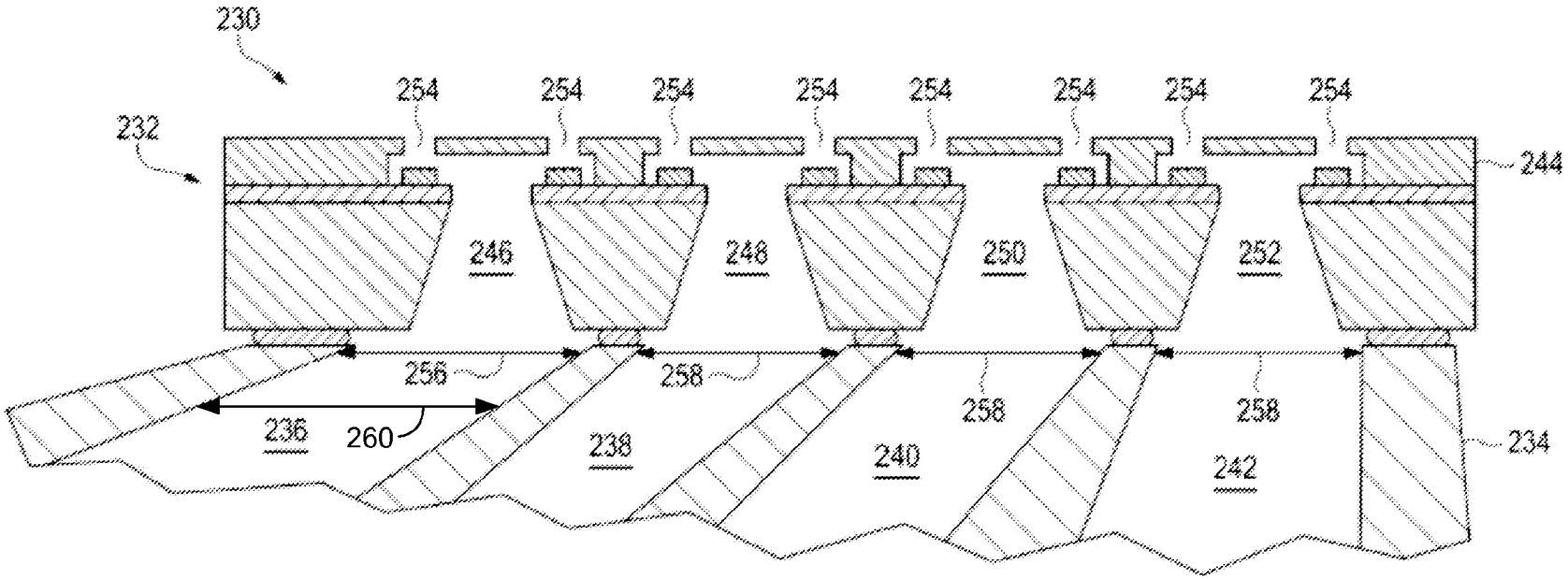
FIG. 10 is an enlarged view of yet a further example of a portion of a fluid dispenser.

An enlarged view of yet a further example of a portion of a fluid dispenser 230 is shown in FIG. 10. As can be seen in FIG. 10, fluid delivery assembly 232 of fluid dispenser 230 includes a manifold 234 that is configured to include a plurality of differently slanted fluid passageways 236, 238, 240, and 242 each of which is configured to have a different angle relative to member 244 as shown. Fluid delivery assembly 232 additionally includes a plurality of slots 246, 248, 250, and 252 each of which is coupled to a different respective fluid passageway 236, 238, 240, and 242 of manifold 234 to conduct fluid from fluid passageways 236, 238, 240, and 242 towards orifices 254 of member 244. In this example, slots 246, 248, 250, and 252 are configured to have a substantially similar shape. Additionally, in this example, fluid passageway 236 is configured to have a greater cross-sectional width adjacent slot 246 than fluid passageways 238, 240, and 242 adjacent respective slots 248, 250, and 252, as generally indicated by double arrows 256 and 258. Further, in this example, cross-sectional width 256 of fluid passageway 236 is configured to be less than cross-sectional width 260 to help facilitate conveyance of bubbles through fluid passageway 236.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, in another embodiment, actuators 118, 120 122, and 124 may be transducers, instead of resistors, that are energized to vibrate which forms drops that are ejected from orifices 102, 104, 106, and 108. As another example, the cross-sectional width of each of the slots can be configured based on the particular fluid passageway to which it is coupled such that the cross-sectional width of slots is relatively narrower for those fluid passageways that have a larger angle relative to the member and that is relatively wider for those fluid passageways that have a smaller angle relative to the member. As a further example, the bubble purging assembly is designed to also remove any bubbles arising in the slots of the fluid delivery system in addition to any of those arising in the fluid chambers. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A fluid dispenser, comprising:

a member including a first surface and a second surface, a first fluid chamber and a second fluid chamber, and a first orifice and a second orifice, the first orifice being in fluid communication with the first fluid chamber, the second orifice being in fluid communication with the second fluid chamber, the first orifice and the second orifice configured to eject fluid;

a planar film layer including a first surface and a second surface and further including an opening having a cross-sectional width, the first surface of the film layer being coupled to the second surface of the member such that the opening is in fluid communication with the first fluid chamber and the second fluid chamber;

a first actuator positioned on the first surface of the film layer and positioned in the first fluid chamber;

a second actuator positioned on the first surface of the film layer and positioned in the second fluid chamber;

a substrate including a first surface and a second surface and further including a slot, the first surface of the substrate being coupled to the second surface of the film layer such that the slot is in fluid communication with the opening of the film layer, the slot having a first cross-sectional width along the first surface of the substrate and a second cross-sectional width along the second surface of the substrate;

a manifold including a first surface and a second surface and further including a fluid passageway, the first surface of the manifold being coupled to the second surface of the substrate such that the fluid passageway is in fluid communication with the slot, the fluid passageway having a first cross-sectional width along the first surface of the manifold and a second cross-sectional width along the second surface of the manifold; and a fluid container coupled to the manifold such that the fluid container is in fluid communication with the fluid passageway, the fluid container configured to store fluid;

wherein the second cross-sectional width of the slot is greater than the first cross-sectional width of the slot, the first cross-sectional width of the fluid passageway is greater than the second cross-sectional width of the slot, and the second cross-sectional width of the fluid passageway is greater than the first cross-sectional width of the fluid passageway, such that bubbles formed in respective ones of the first fluid chamber and the second fluid chamber are conducted through the opening, through the slot, through the fluid passageway, and to the fluid container.

2. The fluid dispenser of claim 1, wherein the slot has a first geometric shape and the fluid passageway has a second geometric shape, the second geometric shape being different from the first geometric shape.

3. The fluid dispenser of claim 2, wherein the first geometric shape has a first central axis extending from the first surface of the substrate to the second surface of the substrate, the first central axis positioned at a first angle relative to a plane defined by the first surface of the member.

4. The fluid dispenser of claim 3, wherein the second geometric shape has a second central axis extending from the first surface of the manifold to the second surface of the manifold, the second central axis positioned at a second angle relative to the plane defined by the first surface of the member, the second angle being different from the first angle.

5. The fluid dispenser of claim 1, wherein the first actuator includes a first resistor and the second actuator includes a second resistor.

6. The fluid dispenser of claim 1, wherein the first actuator is configured to heat fluid in the first fluid chamber and the second actuator in configured to heat fluid in the second fluid chamber.

7. The fluid dispense of claim 1, wherein the first actuator is configured to eject fluid through the first orifice and the second actuator is configured to eject fluid through the second orifice.

8. The fluid dispenser of claim 1, wherein an adhesive couples the first surface of the manifold to the second surface of the substrate, the adhesive including an opening having a cross-sectional width.

9. The fluid dispenser of claim 8, wherein a height of the adhesive is less than the cross-sectional width of the opening of the adhesive.

10. The fluid dispenser of claim 8, wherein the cross-sectional width of the opening of the adhesive is greater than the second cross-sectional width of the slot.

11. The fluid dispenser of claim 1, wherein the member is formed from at least one of a dielectric material or a photoimageable epoxy material.

12. The fluid dispenser of claim 1, wherein the substrate is formed from a semiconductor material.

13. The Fluid dispenser of claim 1, wherein the manifold is formed from at least one of a polymer material, a metal material or a ceramic material.

14. The fluid dispenser of claim 1, further including a printing device.

15. The fluid dispenser of claim 1, wherein the film layer insulates conductors coupled to the first and second actuators.

16. The fluid dispenser of claim 1, wherein the opening of the film layer is a first opening of the film layer, the slot of the substrate is a first slot of the substrate, the fluid passageway of the manifold is a first fluid passageway of the manifold, and the fluid container is a first fluid container, the fluid dispenser further comprising:

a third fluid chamber, a fourth fluid chamber, a third orifice and a fourth orifice of the member, the third orifice being in fluid communication with the third fluid chamber, the fourth orifice being in fluid communication with the fourth fluid chamber, the third orifice and the fourth orifice configured to eject fluid;

a second opening of the film layer, the second opening having a cross-sectional width, the first surface of the film layer being coupled to the second surface of the member such that the second opening is in fluid communication with the third fluid chamber and the fourth fluid chamber;

a third actuator positioned on the first surface of the film layer and positioned in the third fluid chamber;

a fourth actuator positioned on the first surface of the film layer and positioned in the fourth fluid chamber;

a second slot of the substrate, the first surface of the substrate being coupled to the second surface of the film layer such that the second slot is in fluid communication with the second opening of the film layer, the second slot having a first cross-sectional width along the first surface of the substrate and a second cross-sectional width along the second surface of the substrate;

a second fluid passageway of the manifold, the first surface of the manifold being coupled to the second surface of the substrate such that the second fluid passageway is in fluid communication with the second slot, the second fluid passageway having a first cross-sectional width along the first surface of the manifold and a second cross-sectional width along the second surface of the manifold; and a second fluid container coupled to the manifold such that the second fluid container is in fluid communication with the second fluid passageway, the second fluid container configured to store fluid;

wherein the second cross-sectional width of the second slot is greater than the first cross-sectional width of the second slot, the first cross-sectional width of the second fluid passageway is greater than the second cross-sectional width of the second slot, and the second cross-sectional width of the second fluid passageway is greater than the first cross-sectional width of the second fluid passageway, such that bubbles formed in respective ones of the third fluid chamber and the fourth fluid chamber are conducted through the second opening, through the second slot, through the second fluid passageway, and to the second fluid container.

17. The fluid dispenser of claim 16, wherein the second cross-sectional width of the second slot is different from the second cross-sectional width of the first slot.

18. The fluid dispenser of claim 17, wherein the first cross-sectional width of the second fluid passageway is different from the first cross-sectional width of the first fluid passageway.

19. The fluid dispenser of claim 16, wherein the manifold of the fluid dispenser further includes a first wall, a second wall, a third wall and a fourth wall, the first wall and the second wall defining the first fluid passageway, the third wall and the fourth wall defining the second fluid passageway, the first wall positioned at a first angle relative to a plane defined by the first surface of the member, the second wall positioned at a second angle relative to the plane defined by the first surface of the member, the third wall positioned at a third angle relative to the plane defined by the first surface of the member, the fourth wall positioned at a fourth angle relative to the plane defined by the first surface of the member, the second angle being different from the first angle, the third angle being different from both the first angle and the second angle.

20. The fluid dispenser of claim 19, wherein the fourth angle is different from each of the first angle, the second angle and the third angle.

* * * * *